US005974818A

United States Patent [19]

Topper et al.

[11] Patent Number: 5,974,818

[45] Date of Patent: Nov. 2, 1999

[54] LOW TEMPERATURE STATIC DISPLAY

[75] Inventors: Robert T. Topper, Heber Springs; Joseph F. Sanders; William E. Zellner, both of Conway, all of Ark.

[73] Assignee: White Consolidated Industries, Inc., Cleveland, Ohio

[21] Appl. No.: 09/014,515

[22] Filed: Jan. 28, 1998

Related U.S. Application Data

[60] Provisional application No. 60/036,698, Jan. 31, 1997, and provisional application No. 60/039,560, Feb. 28, 1997.

[51] Int. Cl.[6] ..... A47F 3/04

[52] U.S. Cl. ..... 62/255

[58] Field of Search ..... 62/255, 256

[56] References Cited

U.S. PATENT DOCUMENTS

| | | | |
|---|---|---|---|
| 1,847,544 | 3/1932 | Weber . | |
| 1,887,402 | 11/1932 | Domm . | |
| 1,896,693 | 2/1933 | Battista . | |
| 2,175,498 | 10/1939 | Wilnau . | |
| 2,252,237 | 8/1941 | Stiles . | |
| 2,360,189 | 10/1944 | Anderson . | |
| 2,529,384 | 11/1950 | Greiling | 62/255 |
| 2,561,517 | 7/1951 | Ladge . | |
| 2,565,795 | 8/1951 | Amundsen, Jr. . | |
| 2,574,242 | 11/1951 | Brill et al. . | |
| 2,661,604 | 12/1953 | Baker . | |
| 2,669,851 | 2/1954 | Pichler . | |
| 2,674,102 | 4/1954 | Stile . | |
| 2,686,405 | 8/1954 | Pichler . | |
| 2,712,733 | 7/1955 | King . | |
| 2,775,873 | 1/1957 | Jones . | |
| 3,680,941 | 8/1972 | Shanks . | |
| 3,729,243 | 4/1973 | Musgrave et al. . | |
| 3,751,653 | 8/1973 | Henry . | |
| 3,860,306 | 1/1975 | Kenyon . | |
| 4,270,819 | 6/1981 | Ooho | 62/255 |
| 4,400,046 | 8/1983 | Karashima . | |
| 4,750,335 | 6/1988 | Wallace et al. | 62/256 |
| 5,046,328 | 9/1991 | Yoshida et al. . | |
| 5,081,850 | 1/1992 | Wakatsuki et al. . | |
| 5,182,924 | 2/1993 | Trulaske, Sr. . | |
| 5,402,651 | 4/1995 | Schulak . | |
| 5,496,103 | 3/1996 | Kozak . | |
| 5,860,289 | 1/1999 | Wetzel | 62/255 |

FOREIGN PATENT DOCUMENTS

| | | |
|---|---|---|
| 8-327206 | 12/1996 | Japan . |

*Primary Examiner*—William E. Tapolcai

*Attorney, Agent, or Firm*—Pearne, Gordon, McCoy & Granger LLP

[57] ABSTRACT

A low temperature frozen food display case that allows a consumer to directly view a frozen product contained therein and which minimizes moisture loss from the frozen food. The display case provides an base member which defines a first portion of a cooling air passageway, side walls extending upwardly from the base member, inner and outer members which are sealed to the side walls and the base member and cooperate to define a second portion of the cooling air passageway. A rear wall defines a plurality of access openings which are selectively closed by pivotal doors. Each of the doors define a third portion of the cooling air passageway through which cooling air from an outlet of the passageway first portion is communicated to the passageway second portion. Food contained within the food storage compartment is not directly contacted by cold air which flows through the cooling air passageway surrounding the storage compartment and, therefore, moisture loss is reduced.

17 Claims, 4 Drawing Sheets

LOW TEMPERATURE STATIC DISPLAY

CROSS-REFERENCE TO RELATED APPLICATIONS

This application claims the benefit of U.S. provisional application Ser. Nos. 60/036,698 Jan. 31, 1997 and 60/039,560 Feb. 28, 1997.

BACKGROUND OF THE INVENTION

A current trend in merchandising is to present products in their authentic state, not imitations or representations, thus increasing their visual appeal. This is particularly difficult to accomplish, however, with ice cream and other frozen foods which, when exposed for viewing purposes, will degrade in quality and appearance.

Low temperature cabinets for displaying and merchandising frozen foods have been manufactured for many years. With these cabinets, however, exposed products, especially ice-cream cream products, quickly deteriorate. This occurs because frozen dairy products contain a high concentration of water, and water molecules diffuse through and migrate out of the product. This diffusion is driven by vapor pressure differences which relate to temperatures in general, and dew point temperatures in particular. The greater the difference between the dew point of the product and its surroundings, the greater the diffusion rate and moisture loss. Moisture loss can be further accelerated if the air surrounding the product is in motion, as it is in a forced convection system. Migration of moisture from the frozen product degrades product quality, and causes the product to lose visual appeal.

Display cases typically use a fan to circulate cold air within the display case and over the frozen product. The air is chilled by a direct expansion refrigeration coil whose temperature may be as much as forty degrees below the cabinet air temperature. The dew point of the air is nearly equal to the surface temperature of the coil, while the dew point of the product is the same as the air temperature. The difference between the dew points results in a high rate of moisture loss from the frozen product.

Therefore, there exists a need in the art for a low temperature display device which permits a consumer to directly view a frozen product to be sold while the product is maintained at a below freezing temperature. There is also a need in the art for such a display device in which food may be maintained for long periods of time without substantial reduction in moisture content, quality, consistency, or appearance.

SUMMARY OF THE INVENTION

The present invention is directed toward a low temperature frozen food display device that allows a consumer to directly view a frozen product contained therein. The present invention is further directed toward such a display device in which frozen foods can be stored for long periods of time without moisture loss from the frozen food, and without degradation of the food quality, consistency, or appearance.

In accordance with the present invention, a display device includes a cabinet having an inner box and an outer box. The inner box and outer box have transparent walls to permit visualization of frozen foods stored within the inner box. The inner box is hermetically sealed to prevent moisture migration from the food to a cold air stream circulated around the inner box. The inner box is bathed in cold air such that the inner box, and the frozen food contained therein, are maintained at substantially the same below freezing temperature.

In further accordance with the present invention, the inner box and the outer box share common side or end walls. The inner and outer boxes also have an access door which seals the inner box and the outer box. The access door defines a portion of a cold air passageway that surrounds the inner box and through which cold air is circulated.

BRIEF DESCRIPTION OF THE DRAWINGS

These and further features of the present invention will be apparent with reference to the attached specification and drawings, wherein.

DETAILED DESCRIPTION OF THE PREFERRED EMBODIMENT

Figure 1:
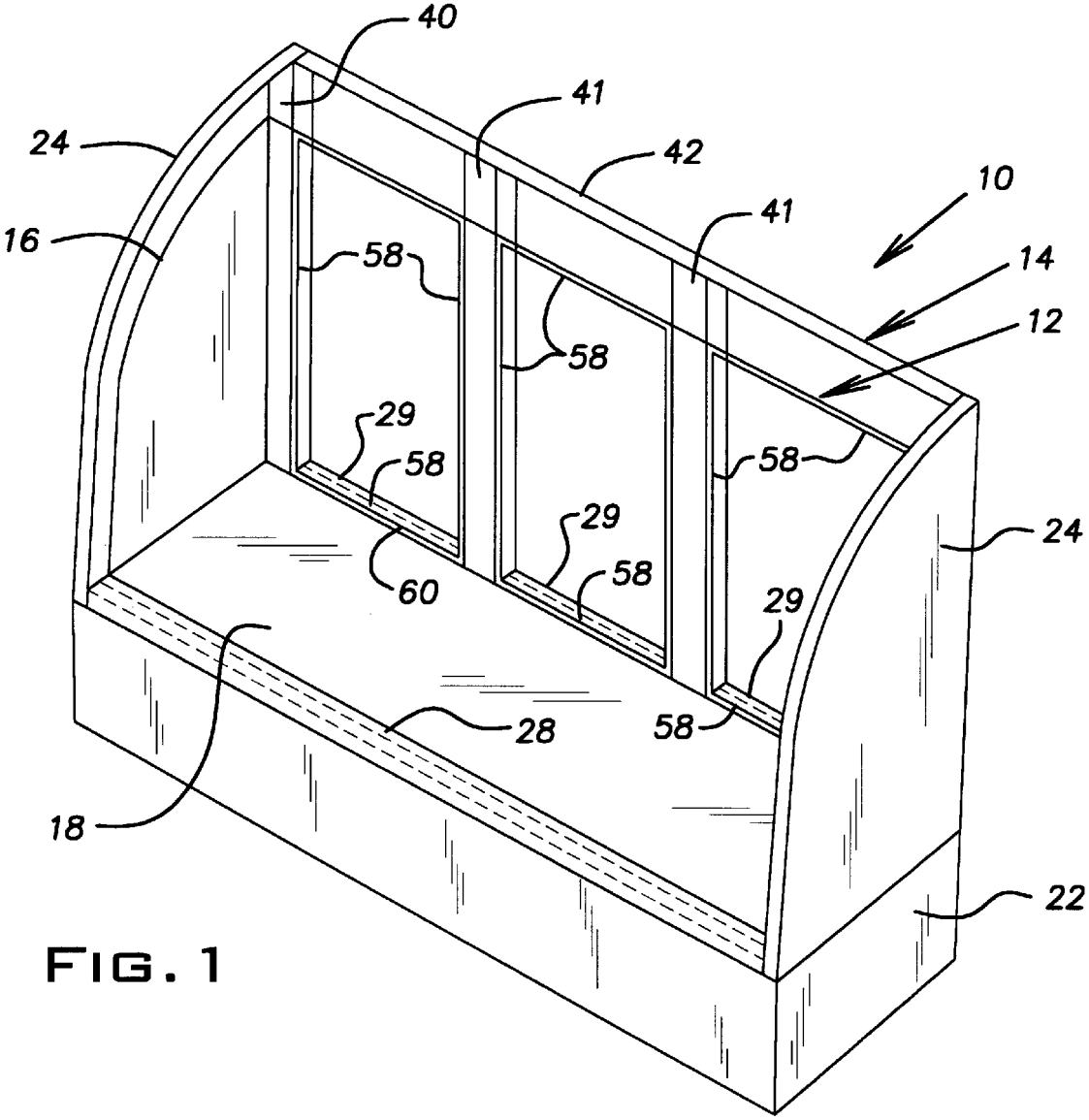
FIG. 1 is a perspective view of a static display cabinet according to the present invention, with the doors removed for purposes of clarity.

It should be noted that in the detailed description which follows, identical components have the same reference numeral, regardless of whether they are shown in different embodiments of the present invention. It should also be noted that, in order to clearly and concisely disclose the present invention, the drawings may not necessarily be to scale and certain features of the invention may be shown in somewhat schematic form.

With reference to the drawings, a display cabinet 10 according to the present invention incorporates an inner compartment or box 12 surrounded by an outer compartment or box 14. The inner box 12 has a transparent, insulated glass upper wall or portion 16 and a base wall or portion 18. The outer box 14 has a transparent, insulated glass upper wall or portion 20 and a base portion 22. The inner box base portion 18 may, preferably, be an upper wall of the outer box base portion 22, as illustrated. The upper portion 16 of the inner box 12 defines a top and front wall of the inner box 12, while the upper portion 20 of the outer box 14 defines a top and front wall of the outer box 14.

The inner box upper portion 16 is spaced inwardly from the outer box upper portion 20 a generally uniform distance, preferably about two inches. The outer box upper and base portions 20, 22 are hermetically sealed to one another along the front, bottom edge of the upper portion 20. The inner box upper and base portions 16, 18 are hermetically sealed to one another along the front, bottom edge of the upper portion 16. The upper portions 16, 20 are secured and hermetically sealed to side or end walls 24 of the cabinet 10, as illustrated. The space between the inner and outer box upper portions 16, 20 defines a portion of a cold air passageway 26 which generally surrounds the inner box 12.

The inner box base wall or portion 18 is secured at each lateral end to the end walls 24, and has a forward end hermetically sealed to the inner box upper portion 16. A forward grate 28 is disposed in the air passageway 26 between the inner box base portion 18 and the outer box base portion 22, as illustrated best in FIG. 1. Similarly, a plurality of rearward grates 29 are disposed in the air passageway 26 at a rear edge of the outer box base portion 22. The grates 28, 29 may, optionally, integrally extend from the inner box base portion 18. The grates 28, 29 have a series of slotted openings to permit air within the passageway 26 to flow into and out of the area beneath the inner box base portion 18 where the refrigeration equipment is located.

An evaporator 30 and a fan 32 are preferably disposed within the cooling air passageway 26 and, more particularly, between the inner box base portion 18 and the outer box base portion 22, as illustrated. The fan 32 circulates cold air from the evaporator 30 through the cooling air passage 26 and around the inner box 12.

A series of mullions or pillars 40, 41 extend upwardly from the outer box base portion 22. A header member 42 interconnects the top of the pillars 40, 41, and has a rearward edge of the outer box upper portion 20 hermetically sealed and secured thereto. A rearward edge of the inner box upper portion 16 is secured to the pillars 40, 41, but is spaced downwardly and inwardly from the header member 42 to define a gap or space (FIG. 3) between the inner and outer box upper portions 16, 20 which is a portion of the cold air passageway 26.

In the illustrated and preferred embodiment, a pair of corner pillars 40 are secured to inner sides of the end walls 24, while a pair of intermediate pillars 41 are disposed between the end walls 24. The pillars 40, 41, header 42, and the outer box base portion 22 cooperate to define a frame member that delimits a plurality of access openings (FIG. 1). Each of the access openings is covered by a pivotal door 50. Furthermore, the pillars 40, 41 and header 42 define a rear side wall of the display case having a series of openings which receive one of the doors 50.

Figure 2:
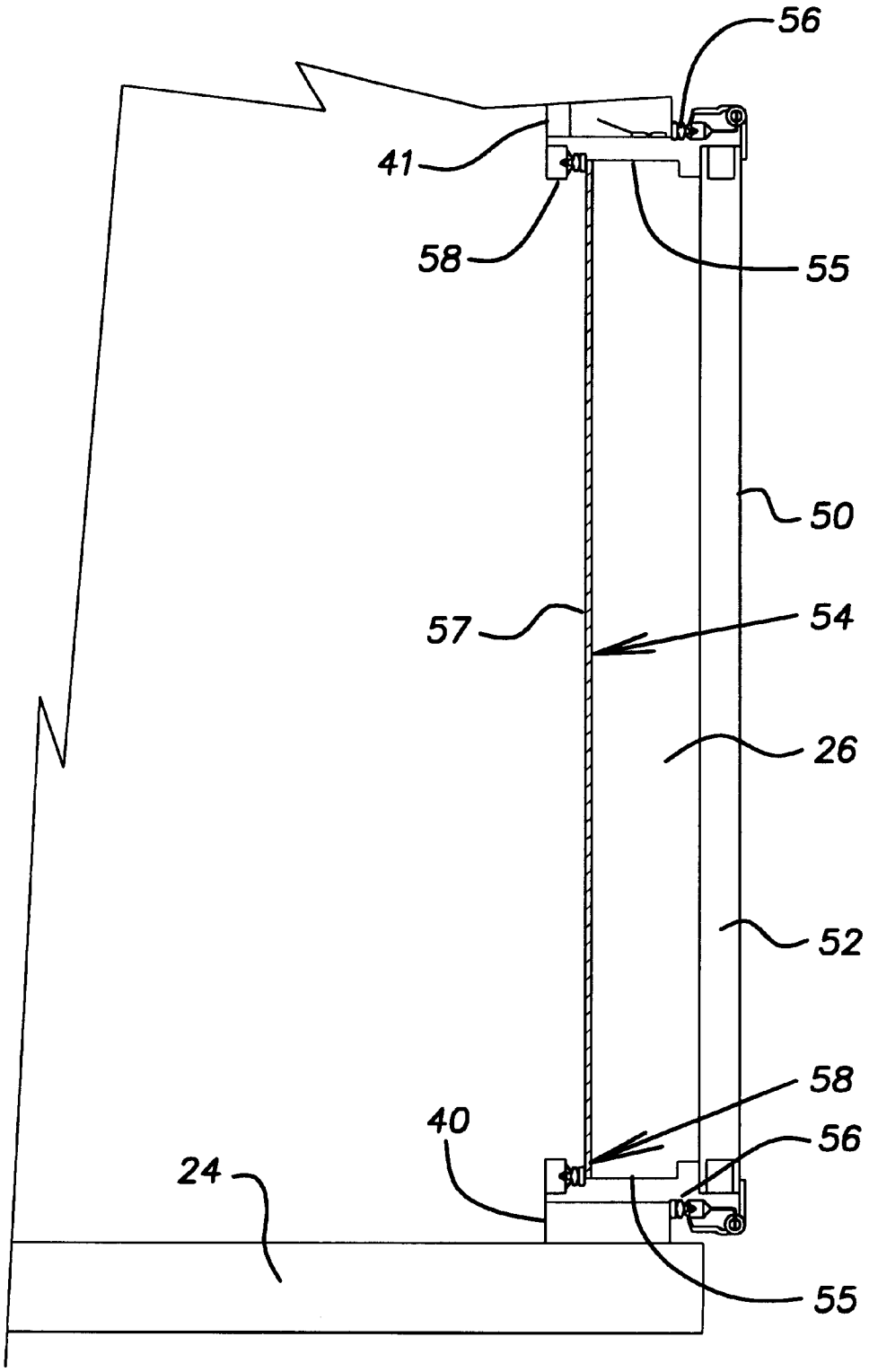
FIG. 2 is a top plan view, in cross section, of a door and the cabinet according to the present invention.
Figure 3:
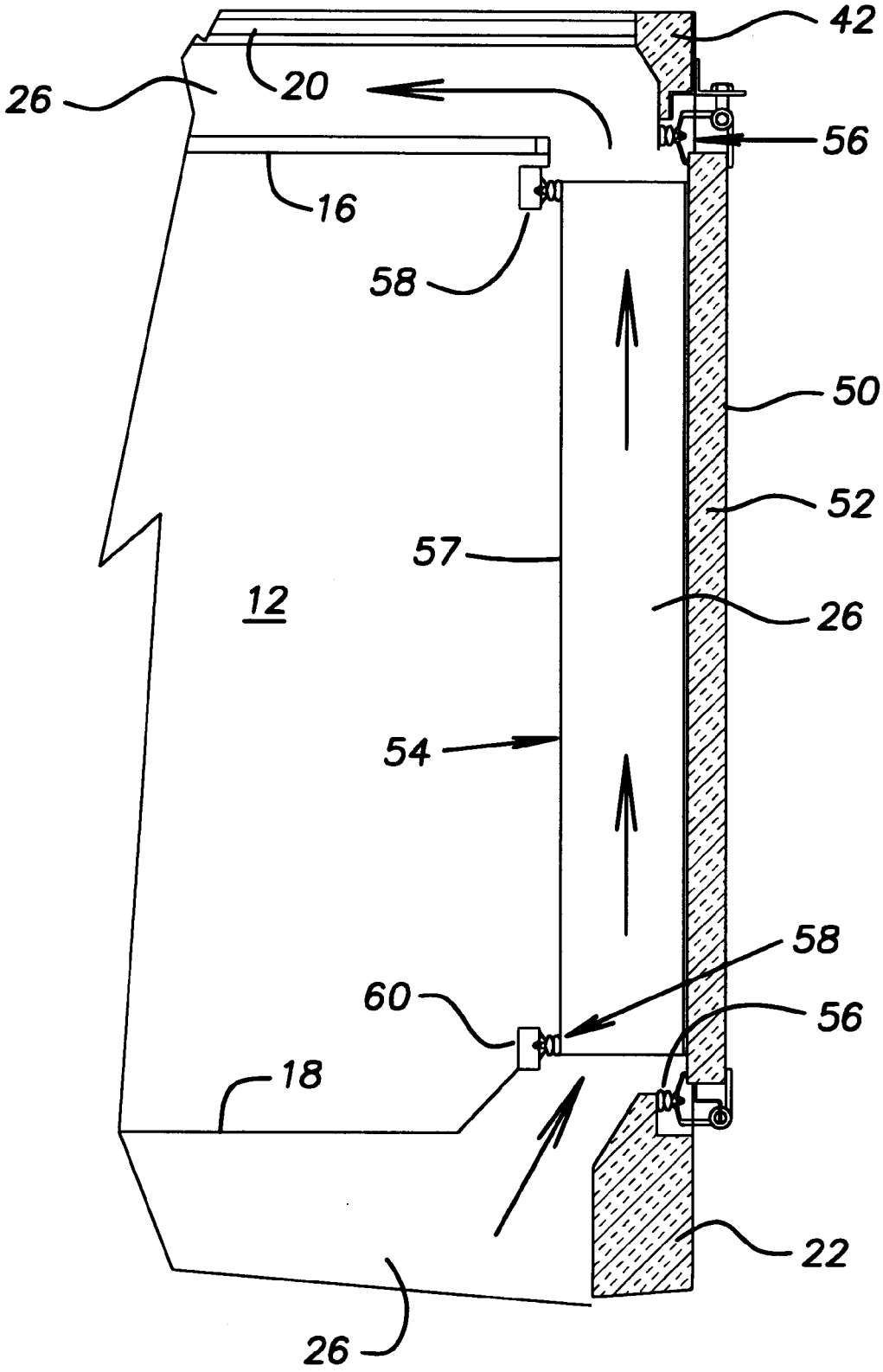
FIG. 3 is a side elevational view, in cross section, of the door and the cabinet.
Figure 5:
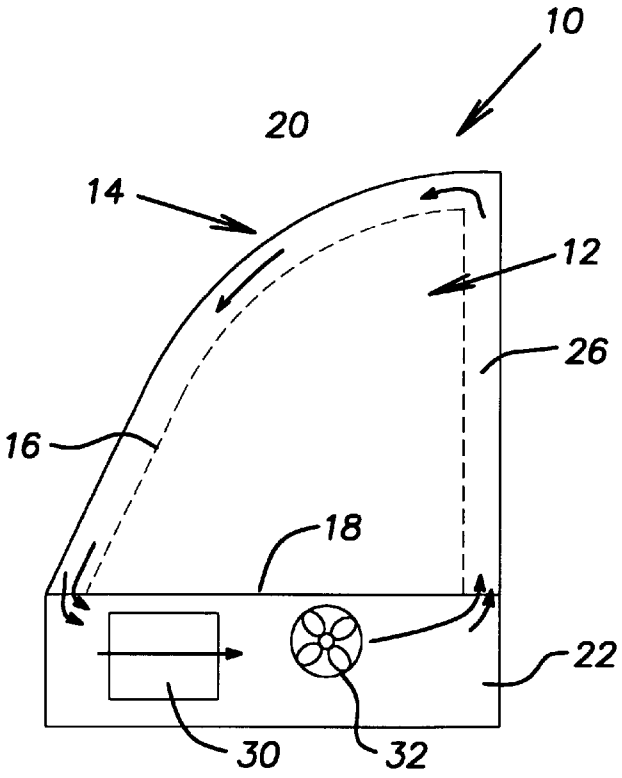
FIG. 5 is schematically illustrates air flow through the cabinet according to the present invention.
Figure 4:
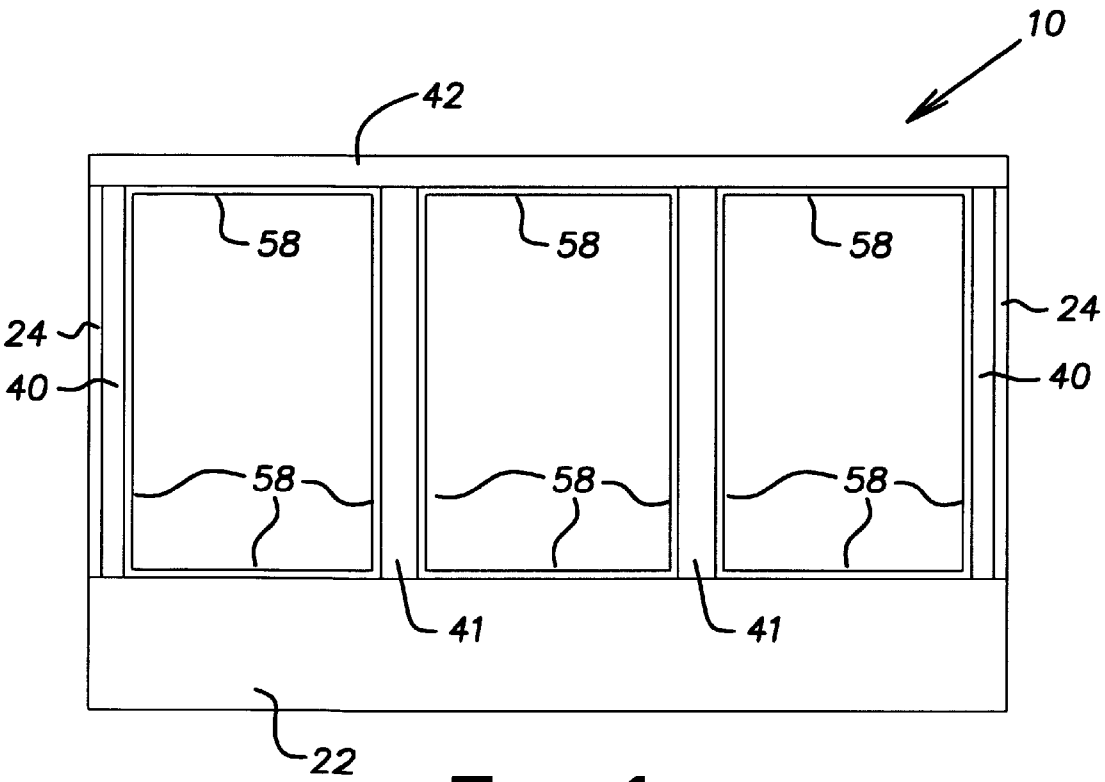
FIG. 4 is a rear elevational view of the cabinet, with the doors removed for purposes of clarity.

Each door 50, as shown best in FIGS. 2 and 3, comprises a planar door body 52 to which a panel member 54 is fixedly secured. The panel member 54 includes a pair of laterally spaced-apart legs 55 which are secured to the inner side of the door body 52, but spaced inwardly from the door body periphery (FIGS. 2 and 3). The legs 55 support a planar member 57 in spaced relationship to the door body 52, as illustrated. The panel member 54 cooperates with the door body 52 to define a duct-like passage which is open at a top and bottom end and which serves as a portion of the cold air passageway 26.

An outer magnetic sealing gasket 56 is attached about the inwardly facing periphery of the door body 52 and surrounds the panel member 54. The outer magnetic sealing gasket 56 hermetically seals the door 50 to the cabinet (i.e., the pillars 40, 41, header 42, and base portion 22).

The planar member 57 of the panel 54 has an inwardly facing peripheral surface that defines a seat for hermetic sealing engagement with an inner magnetic sealing gasket 58, which is attached to a rearward edge of the inner box upper portion 20, the pillars 40, 41, and a projecting flange 60 of the inner box lower portion 18, to seal the interior of the inner box 12 from the cold air passageway 26. Accordingly, the panel member 57 cooperates with the pillars 40, 41, end walls 24, and inner box base and upper portions 18, 20, to define an internal storage compartment which is isolated from the cold air flowing in the cooling air passageway 26. As should be apparent, access to the internal storage compartment is gained by pivotally opening the door 50 and reaching through the access opening.

It is noted that the inner magnetic sealing gasket 58 has a smaller circumference than the outer magnetic sealing gasket 56. Due to the sealing action of the gaskets 56, 58, when the door 50 is closed cold air is confined within and circulated through the passageway 26, including the portion of the passageway defined by the door body 52 and the panel member 54, and around the inner box 12. The door 50 is thus double sealed, while the space between the seals 56, 58 defines a portion of the air passageway 26.

The inner box 12 serves as a vapor barrier to prevent moisture migration from the frozen food within the inner box 12 to the low temperature evaporator 30. Refrigerated air circulates in the passageway 26 and around the exterior of the inner box 12, cooling it, and therefore its contents, to a uniform low temperature. Since moisture cannot escape from the inner box 12, and both the air and frozen products within the inner box 12 are at the same temperature, they quickly reach an equilibrium dew point, and moisture loss is minimized or eliminated.

As should be apparent from the foregoing, the foods within the inner box 12 can be kept for long periods of time without substantial deterioration in appearance, texture or quality. Moreover, due to the isolation of the food from the cold air stream within the passageway 26, and the hermetic seal/vapor barrier provided by the inner box 12, moisture loss from the food is drastically reduced, or eliminated. Finally, since the upper portions 16, 20 of the inner and outer boxes 12, 14 are transparent, the consumer may directly view the food within the inner box 12, which is a substantial advantage from a marketing/sales perspective.

Although the preferred embodiment of the present invention has been illustrated and described with particularity herein, it should be apparent that the present disclosure is exemplary in nature and is not to be considered to limit the scope of the present invention. Various sizes and shapes of cabinets are possible using the present invention. Moreover, numerous other door/panel member arrangements are possible without departing from the scope and spirit of the present invention. It should also be noted that although the doors 50 and portions of the cabinet are shown as being made of conventional insulated metal, it is contemplated that the entire cabinet wall structure could be formed from multi-pane insulated glass or other transparent material to further enable visualization of the product stored within the cabinet.

What is claimed is:

1. A refrigerated display case, comprising:

a base portion providing a chamber for receipt of refrigeration equipment, said base portion defining a first portion of a cooling air passageway;

a pair of side walls extending upwardly from said base portion;

an outer member extending between said side walls, said outer member being sealingly secured to said side walls and said base portion;

an inner member extending between said side walls and at least partially surrounded by said outer member, said inner member being sealingly secured to said side walls and said base portion, said inner member and said outer member being spaced apart a distance to define a second portion of said cooling air passageway;

a rear wall extending between said side walls and defining at least one access opening, said outer member being secured to said rear wall while said inner member is spaced from at least a portion of said rear wall;

an inlet to said passageway first portion from said passageway second portion;

an outlet from said passageway first portion through which cooling air flows toward said passageway second portion.

2. A refrigerated display case according to claim 1, further comprising a door, said door being pivotally secured to said rear wall and comprising a door body and a panel member, said panel member cooperating with said door body to define a third portion of said cooling air passageway, said third portion fluidly connecting said cooling air passageway first portion outlet with said cooling air passageway second portion.

3. A refrigerated display case according to claim 2, wherein, when said door is in a closed position, said panel member is sealingly secured to an edge of said inner member and said door body is sealingly secured to said rear wall.

4. A refrigerated display case according to claim 3, wherein at least a portion of said inner and outer members is transparent.

5. A refrigerated display case according to claim 1, wherein said rear wall comprises a plurality of pillars extending upwardly from said base portion, and a header member interconnecting distal ends of said pillars, and wherein said pillars, header member, and base portion cooperate to define a plurality of access openings.

6. A refrigerated display case according to claim 5, further comprising a plurality of doors, each of said doors being pivotally movable between a closed position and an open position.

7. A refrigerated display case according to claim 6, wherein each of said doors comprise a door body and a panel member, said panel member cooperating with said door body to define a third portion of said cooling air passageway, said third portion fluidly connecting said cooling air passageway first portion outlet with said cooling air passageway second portion.

8. A refrigerated display case according to claim 7, wherein, when said door is in said closed position, said inner member is sealingly secured to said panel member and said door body is sealingly secured to said header member.

9. A refrigerated display case according to claim 5, wherein said pillars extend between said base portion and said header member and include at least two corner pillars and at least one intermediate pillar, said at least two corner pillars being disposed adjacent said side walls and being secured to said inner and outer members, said at least one intermediate pillar being secured to said inner and outer members.

10. A refrigerated display case according to claim 9, further comprising a plurality of doors, each of said doors being pivotally movable between a closed position and an open position and comprising a door body and a panel member, said panel member cooperating with said door body to define a third portion of said cooling air passageway, said third portion fluidly connecting said cooling air passageway first portion outlet with said cooling air passageway second portion.

11. A refrigerated display case according to claim 10, wherein, when said door is in said closed position, said inner member is sealingly secured to said panel member and said door body is sealingly secured to said header member.

12. A refrigerated display case according to claim 6, wherein said pillars, inner member, and base portion cooperate to define a first, inner seat and said pillars, header, and base portion cooperate to define a second, outer seat, said inner and outer seats generally surrounding said access openings and being in sealing engagement with said doors when said doors are in the closed position.

13. A refrigerated display case according to claim 12, wherein each of said doors comprise a door body and a panel member, said panel member cooperating with said door body to define a third portion of said cooling air passageway, said third portion fluidly connecting said cooling air passageway first portion outlet with said cooling air passageway second portion.

14. A refrigerated display case according to claim 13, wherein, when said door is in the closed position, said panel member is sealingly secured to said inner seat and said door body is sealingly secured to said outer seat.

15. A refrigerated display case according to claim 14, wherein said cooling passageway first portion outlet is disposed relatively between said inner and outer seats.

16. A refrigerated display case according to claim 15, wherein said inner and outer members are transparent.

17. A refrigerated display case according to claim 15, wherein each of said inner and outer members are formed from a curved transparent material.

* * * * *

UNITED STATES PATENT AND TRADEMARK OFFICE

CERTIFICATE OF CORRECTION

PATENT NO. : 5,974,818
DATED : November 2, 1999
INVENTOR(S) : Topper et al.

It is certified that error appears in the above-indentified patent and that said Letters Patent is hereby corrected as shown below:

Column 1, Line 19, after "ice-cream" delete "cream".

Signed and Sealed this

Sixth Day of June, 2000

*Attest:*

Q. TODD DICKINSON

*Attesting Officer*

*Director of Patents and Trademarks*